US005410777A

United States Patent [19]

Gruber

[11] Patent Number: 5,410,777

[45] Date of Patent: May 2, 1995

[54] AUTOMATIC CHECKING MECHANISM

[75] Inventor: Rudolf Gruber, Claremont, Canada

[73] Assignee: Multimatic Inc., Markham, Canada

[21] Appl. No.: 786,725

[22] Filed: Nov. 1, 1991

[30] Foreign Application Priority Data

Nov. 2, 1990 [CA] Canada ..... 2029257

[51] Int. Cl.[6] ..... E05F 3/12; E05F 3/22

[52] U.S. Cl. ..... 16/58

[58] Field of Search ..... 16/51, 82, DIG. 21, 16/58, 54

[56] References Cited

U.S. PATENT DOCUMENTS

| | | | |
|---|---|---|---|
| 2,036,474 | 5/1936 | Hanson . | |
| 2,948,915 | 8/1960 | Vose | 16/82 |
| 3,212,122 | 10/1965 | Flint . | |
| 3,584,331 | 6/1971 | D'Hooge | 16/82 |
| 4,267,619 | 5/1981 | Suska . | |
| 4,653,141 | 3/1987 | Converse . | |
| 4,689,849 | 9/1987 | Eger et al. . | |
| 4,756,051 | 7/1988 | Shy . | |
| 4,774,875 | 10/1988 | Amshoff, III . | |
| 4,889,151 | 12/1989 | Oten . | |

FOREIGN PATENT DOCUMENTS

| | | |
|---|---|---|
| 981707 | 1/1976 | Canada . |
| 1010914 | 5/1977 | Canada . |
| 0230524 | 8/1987 | European Pat. Off. . |
| 2594473 | 8/1987 | France . |
| 3642442 | 8/1987 | Germany . |

*Primary Examiner*—P. Austin Bradley
*Assistant Examiner*—Chuck Y. Mah
*Attorney, Agent, or Firm*—Ivor M. Hughes; Neil H. Hughes; Marcelo K. Sarkis

[57] ABSTRACT

A check or stop for a moveable member, the check or stop comprising actuated means actuated by the moveable member, or alternatively by seperate actuating means, the actuated means being either fastened with the moveable member or being integral with the moveable member, automatic switching means to control the checking and release of the actuated means and the moveable member, the moveable member being moveable from a first state, wherein the moveable member is substantially static, checked, and exhibits a first value for a predetermined characteristic of the actuated means, to a second state wherein the moveable member is substantially in motion, unchecked, and exhibits a second value of the predetermined characteristic of the actuated means, the value of the predetermined characteristic of the actuated means being available to the automatic switching means, wherein when the moveable member is in a static state the first value of the predetermined characteristic available to the automatic switching means provides checking of the actuated means and the motion of the moveable member, wherein when the moveable member is substantially in motion the second value of the predetermined characteristic available to the automatic switching means provides release of the actuated means and the moveable member to allow ease of movement thereof.

31 Claims, 12 Drawing Sheets

LOCK POSITION

MOVING POSITION

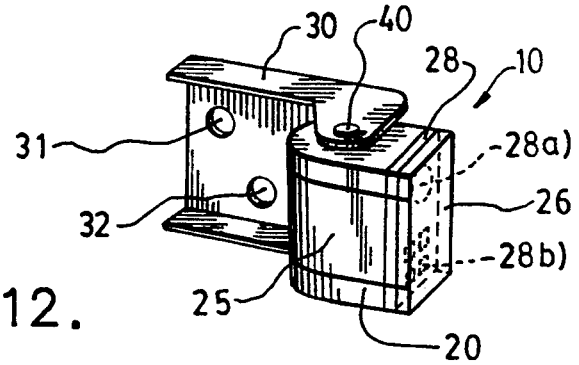
FIG. 12.
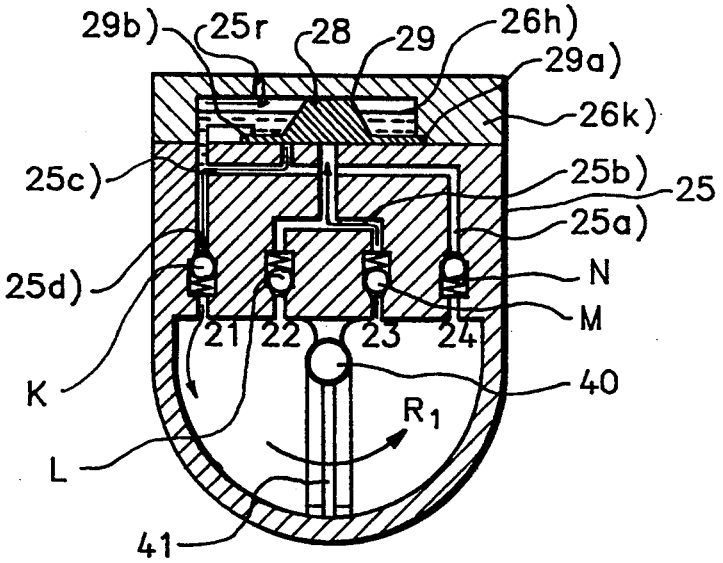
FIG. 12A.
FIG. 13.
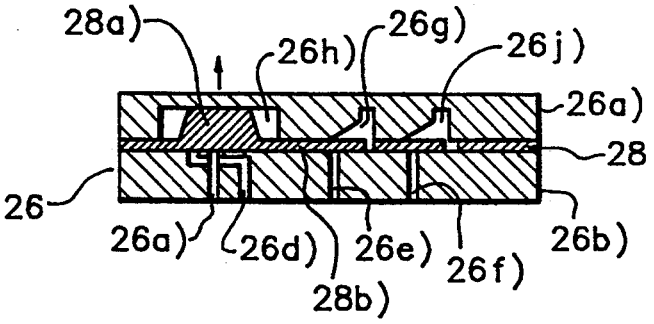
FIG. 14.
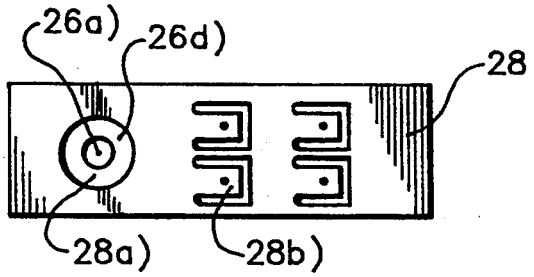

AUTOMATIC CHECKING MECHANISM

FIELD OF THE INVENTION

This invention relates to checking mechanisms for checking the motion of a moveable member in preferably an infinite number of positions. It finds specific application as a door check for a vehicle door, or a stay for a rotatable wheel on a carriage or the like.

BACKGROUND OF THE INVENTION

Checking mechanisms stops and stays are known in the art. For example the checking mechanisms are mechanical and include a roller contained in a housing fixed to a vehicle door, the rollers having a rod passing between them and the rod normally has a number of discrete raised portions or recesses. As such a checking mechanism having discrete checking positions at each portion where the recesses are located is provided. A considerable amount of force must be applied by a passenger or operator of the vehicle to move it from the checked position to the moveable position.

It would therefor be advantageous if a simple structure were provided which allows for infinite checking of the door when the in the stopped position and ease of movement of the door when it is in the moveable positions. However, mechanical checks will generally on there own not meet this requirement.

U.S. Pat. No. 4,689,849 to Porsche describes a control mechanism for a door including a piston and a blocking valve. The blocking valve is disposed in a controlled circuit so that it may block the flow to the two working chambers of the cylinder and thus arresting the door in any arbitrary position. However, when the door handle is operated it controls the blocking valve which when released allows the flow of the fluid to the working chambers. In using such a structure it therefor is necessary for an operator opening the door to pull on the inside door handle and hold the inside door handle open while the door is being moved. This is not practical and is quite clumsy in operation. Unless, either in the inside or the outside handle is operated the door will remain in a fixed position unless an over pressure situation occurs. However, there is no discussion as to what characteristic occurs with such an over pressure situation.

It therefor would be beneficial if a door for a vehicle to be checked in position automatically when the door substantially stops its movement and which would be easy to move when the door commences its movement without the need of and operator to operate the door handles. Typically in a vehicle, an operator unlatches the lock and pushes the door open via a molded grip on the inside of the door. When exiting the door is closed merely by shutting the door depending on the model of the vehicle. It would therefor be more practical to allow for such automatic checking.

Other examples of door checks are found in the art such as U.S. Pat. No. 2,036,474, U.S. Pat. No. 3,212,122 among others.

Controlled release door holders are also known in the art, which control the motion of the door and prohibit quick opening or closing of the door. Structure such as U.S. Pat. No. 4,267,619 include accelerated closing of a door during a fire, for example. Canadian Patent 981,707 and 1,010,914 are the equivalents of the 619 reference.

Actuators such as those manufactured by Turn Act as taught in U.S. Pat. No. 4,774,875 among others are known in the art. Also known in the art are U.S. Pat. No. 4,653,141 and U.S. Pat. No. 4,756,051 embodied in a hinge. These structures include damping and shock absorbing features, but do not include checking features.

U.S. Pat. No. 4,889,151 describes a snap-action pressure relief valve which operates by taking advantage of an area 83 as seen in FIG. 1 which provides a higher force to open the relief valve, and a reduced force once the relief valve is opened subjected to the same pressure. However, such a structure is not taught within a check or stay mechanism.

Nowhere within the prior art is there found a check or stay mechanism which provides that when the member being checked is substantially stationary that it is checked automatically by the attributes of the structure and when the member being checked is free to move, it is uninhibited during such a motion until it returns to a checked stationary state.

It is therefor a primary object of this invention to provide a check, stop, or stay for a moveable member which is inhibited from moving when in the substantially stationary position and which is uninhibited automatically when the member is moved and remains in a dynamic state.

It is a further object of this invention, to provide such a mechanism in a vehicle door.

It is yet still another object of this invention, to provide such a mechanism for a rotatable caster, roller or wheel, for example material handling carts.

It is yet still another object of this invention, to provide a check, stay or stop for a moveable member in a simple economical and convenient structure.

Further and other objects of this invention will become apparent to a man skilled in the art when considering the following the summary of the invention and the more detailed description of the preferred embodiments illustrated herein.

SUMMARY OF THE INVENTION

According to one aspect of the invention there is provided a check or stop for a moveable member, the check or stop comprising actuated means actuated by the moveable member, or alternatively by separate actuating means, the actuated means being either fastened with the moveable member or being integral with the moveable member, automatic switching means to control the checking and release of the actuated means and the moveable member, the moveable member being moveable from a first state, wherein the moveable member is substantially static, checked, and exhibits a first value for a predetermined characteristic of the actuated means, (for example force, pressure, torque or the like), to a second state wherein the moveable member is substantially in motion, unchecked, and exhibits a second value of the predetermined characteristic of the actuated means, the value of the predetermined characteristic of the actuated means being available to the automatic switching means, wherein when the moveable member is in a static state the first value of the predetermined characteristic available to the automatic switching means provides checking of the actuated means and the motion of the moveable member, wherein when the moveable member is substantially in motion the second value of the predetermined characteristic available to the automatic switching means provides release of the actuated means and the moveable member to allow ease of movement thereof. In one embodiment the switching means includes sensing means to sense the value of the predetermined characteristic.

According to another aspect of the invention there is provided a check or stop for a moveable member, the check or stop comprising hydraulic actuated means actuated by the moveable member, or alternatively by separate actuating means, the hydraulic actuated means being either fastened with the moveable member or being integral with the moveable member, automatic switching means (for example a pressure relief valve) to control the checking and release of the hydraulic actuated means and the moveable member, the moveable member being moveable from a first state, wherein the moveable member is substantially static, checked, and exhibits a first value for a predetermined characteristic of the hydraulic actuated means, (for example pressure, force or the like), to a second state wherein the moveable member is substantially in motion, unchecked, and exhibits a second value of the predetermined characteristic of the hydraulic actuated means, the value of the predetermined characteristic of the hydraulic actuated means being available to the automatic switching means, wherein when the moveable member is in a static state the first value of the predetermined characteristic available to the automatic switching means provides checking of the hydraulic actuated means and the motion of the moveable member, wherein when the moveable member is substantially in motion the second value of the predetermined characteristic available to the automatic switching means provides release of the hydraulic actuated means and the moveable member to allow ease of movement thereof.

According to yet another aspect of the invention there is provided a check or stop for a moveable member (preferably a vehicle door), the check or stop comprising actuated means (preferably including a pin having two portions separated by clutch portions which engage when the moveable member is static and separate when the moveable member is in motion) actuated by the moveable member, or alternatively by separate actuating means, the actuated means being either fastened with the moveable member or being integral with the moveable member, automatic electric switching means (for example a mirco chip with a sensing circuit for sensing the value of the predetermined characteristic, for example a strain gauge) to control the checking and release of the actuated means and the moveable member, the moveable member being moveable from a first state, wherein the moveable member is substantially static, checked, and exhibits a first value for a predetermined characteristic of the actuated means,(for example force, torque, impedance or the like), to a second state wherein the moveable member is substantially in motion, unchecked, and exhibits a second value of the predetermined characteristic of the actuated means, the value of the predetermined characteristic of the actuated means being available to the automatic switching means, wherein when the moveable member is in a static state the first value of the predetermined characteristic available to the automatic switching means provides checking of the actuated means and the motion of the moveable member, wherein when the moveable member is substantially in motion the second value of the predetermined characteristic available to the automatic switching means provides release of the actuated means and the moveable member to allow ease of movement thereof.

According to yet another aspect of the invention there is provided a check or stop for a moveable member (preferably a vehicle door), the check or stop comprising fluid actuated means (preferably a hinge) actuated by the moveable member, or alternatively by separate actuating means, the fluid actuated means being either fastened with the moveable member or being integral with the moveable member, preferably biased pressure relief means to control the checking and release of the actuated means and the moveable member, the moveable member being moveable from a first state, wherein the moveable member is substantially static, checked, and exhibits a first value for a fluid pressure of the actuated means, to a second state wherein the moveable member is substantially in motion, unchecked, and exhibits a second value of the fluid pressure of the actuated means, the value of the fluid pressure of the actuated means being available to the biased pressure relief means, wherein when the moveable member is in a static state the first value of the fluid pressure available to the biased pressure relief means provides checking of, the actuated means, and the motion of the moveable member, wherein when the moveable member is substantially in motion the second value of the fluid pressure available to the biased pressure relief means provides release of, the actuated means, and the moveable member, to allow ease of movement thereof.

According to yet another aspect of the invention the check or stop may further comprise actuated means wherein the actuated means is a hinge including an integral hydraulic actuator. In one embodiment the actuator has at least one wiper blade dividing the actuator into two halves, preferably each half being in communication with the pressure relief means, preferably integral with the hinge. In one embodiment check valve means are provided in paths of communication with the pressure relief means.

According to yet another aspect of the invention the check or stop may further comprise actuated means wherein the actuated means is a hinge including an integral hydraulic gear pump. In one embodiment the pump has two rotors rotatable in opposite directions effecting fluid flow in two directions, the fluid flow being in communication with the pressure relief means, preferably integral with the hinge. In one embodiment check valve means are provided in paths of communication with the pressure relief means.

In another embodiment the actuated means is a hydraulic cylinder operable in two directions and being divided into two chambers preferably each chamber being selectively in communication with the pressure relief means. In one embodiment check valve means are provided in paths of communication with the pressure relief means.

In preferred embodiments of the embodiments of the invention described above, the pressure relief means is a pressure relief valve wherein means are provided with a housing containing the valve or with the valve to allow fluid to by pass the valve. Preferably the housing or valve includes means on the face of the valve piston or with the housing proximate the face of the valve piston to isolate a portion of the face when the valve is closed and to exert the fluid pressure on that isolated portion of the face only until the valve opens, wherein the fluid pressure is exerted on the full face of the valve piston. In another embodiment the means to isolate the portion of the face of the valve piston is an extension of the piston face which extends to a fluid inlet of the housing when the piston face is nearest the housing.

In one embodiment the automatic switching means may comprise a diaphragm having an integral resilient spring formed therewith. Preferably the diaphragm also includes checking means integral therewith.

In another embodiment the pressure relief means may comprise a diaphragm having an integral resilient spring formed therewith. Preferably the diaphragm also includes checking means integral therewith.

In another embodiment the check or stop may comprise a an actuator portion and a relief valve portion, the relief valve portion having a cover having an opening, the cover engaging the actuator portion when the cover and actuator are assembled wherein the opening is adjacent the actuator, the hinge having disposed between the cover and the actuator portion a diaphragm portion having a resilient spring portion, preferably being shaped as a truncated cone, and retained in the opening of the cover, the spring portion having adjacent thereto with the actuator portion ports for hydraulic oil, whereat the spring is compressible in the opening when subjected to the pressure of the hydraulic oil, preferably the diaphragm also includes checking flaps formed with the diaphragm or alternatively formed with a separate diaphragm, the checking flaps being located adjacent the openings of the actuator portion, the openings providing the ability of the checking flaps to move towards the actuator portion but not away from that portion thus providing one way checking.

Some examples of structures which would benefit from the checks or stops of the instant invention besides checks for vehicle doors includes stops for baby carriages or material handling trucks or the like wherein the stop may be integral with the hub of the wheels of the carriage or cart. The actuated means may therefor be a portion of the hub rotatable by the wheel. Any structure including hinges or the like would benefit from the instant invention.

According to yet another aspect of the invention there is provided a hinge with infinite door checking capability, the hinge comprising a body half and a door half and a door check connected to both halves, wherein the door check includes a check valve contained within an actuator, the actuator being moveable when the hinge is operated and thus providing infinite door checking of the door being checked. Preferably, the check portion including a resilient diaphragm or spring which compresses because of the hydraulic pressure generated by the actuator.

BRIEF DESCRIPTION OF THE DRAWINGS

FIG. 12 is a perspective view of a hinge similar to FIG. 1 illustrated in an alternative embodiment of the invention.

FIG. 12A is a view similar to FIG. 3 wherein the piston has been replaced with a diaphragm illustrated in an alternative embodiment of the invention.

FIG. 13 is a close-up view of the portion 26 of FIG. 12 illustrated in one embodiment of the invention.

FIG. 14 is a plan view of the diaphragm 28 of FIG. 13 illustrated in a preferred embodiment of the invention.

DETAILED DESCRIPTION OF THE PREFERRED EMBODIMENTS

Figure 1:
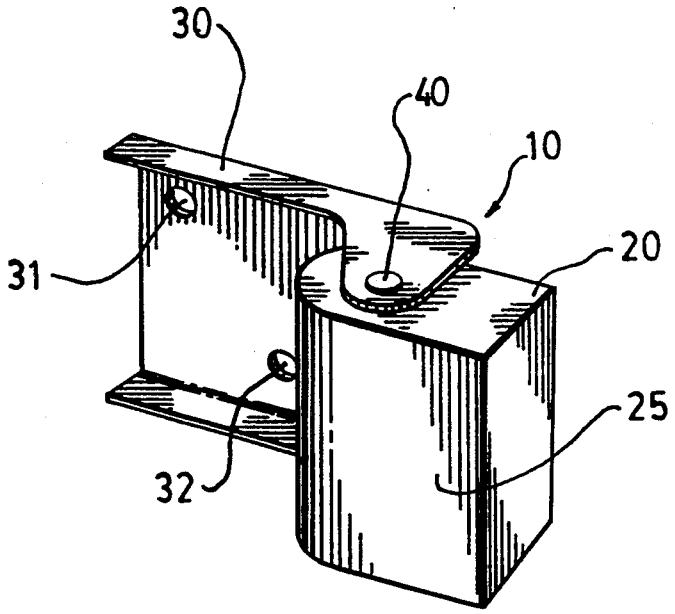
FIG. 1 is a perspective view of a hinge illustrated in a preferred embodiment of the invention.

Referring to FIG. 1 there is illustrated a hinge generally indicated as 10 which is mounted to a vehicle door (not illustrated) by a mounting plate 30 attached to the door and the housing 25 of the hinge attached to the frame of the vehicle. Of course, the attachments may be reversed without effecting the operation of the invention. Mounting plate 30 has openings 31 and 32 for mounting purposes. A pin 40 extends generally through the hinge body 25 from top to bottom of the hinge.

Figure 1A:
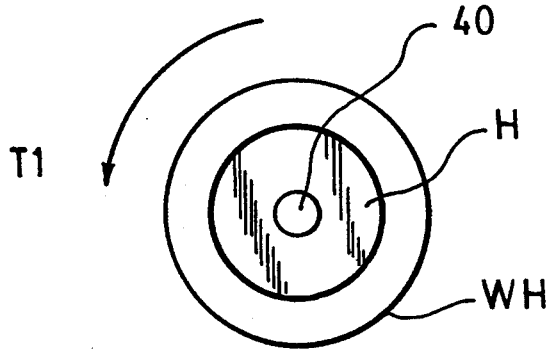
FIG. 1A is a schematic view of an alternative embodiment of the invention.

Alternatively, it is illustrated in FIG. 1A hub portion H illustrated in side view is embodied with a wheel WH which rotates in a direction T1. The pin 40 extends through the hub H which contains the instant invention. In this embodiment of the invention the stop or check may be used to check a rotating wheel when the wheel WH is stationary, and may be released from the check position when the wheel rotates in a direction T1. The components of the hub are similar in operation to the components of the hinge body 25 illustrated in FIG. 1. A frame portion in (not illustrated) is attached to the pin 40. The frame portion may extend to a carriage or a material handling cart or the like.

Figure 2:
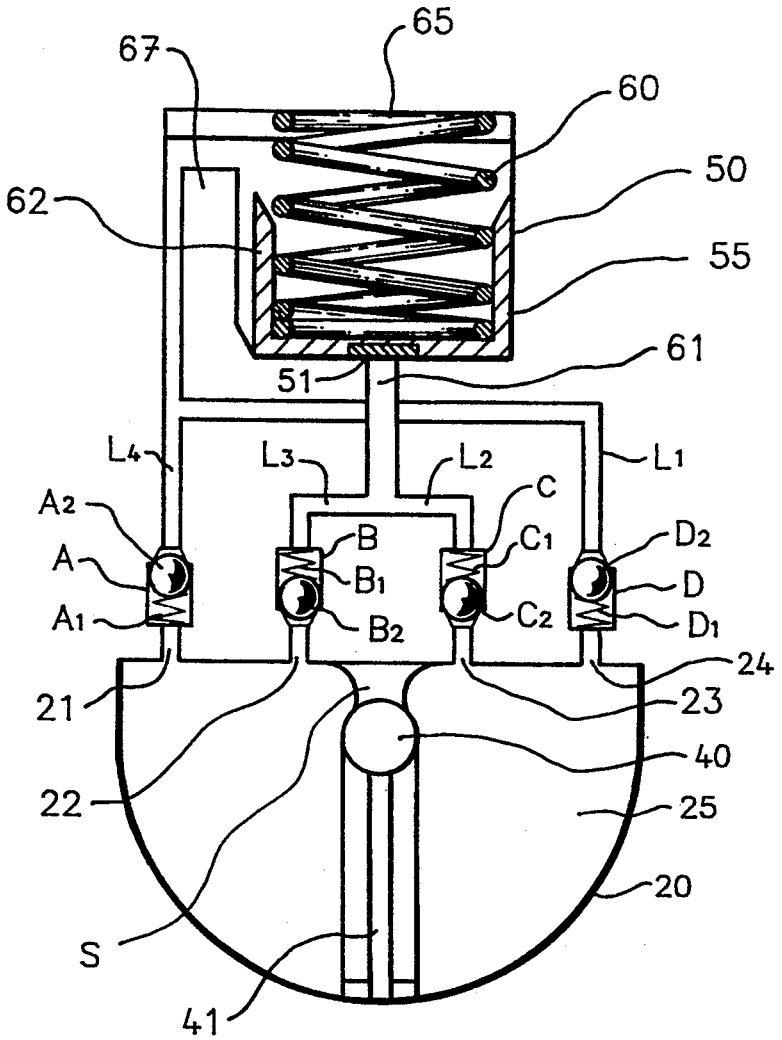
FIG. 2 is a schematic view of the hinge of FIG. 1 showing the internal workings therein illustrated in a preferred embodiment of the invention.

Referring now to FIG. 2, the internal components of the hinge body 25 or the hub H are illustrated wherein the pin 40 of the housing 20 of FIG. 1 includes a wiper portion 41 moveable within the housing 25. Hydraulic oil fills the space within the housing 25. At one end of the housing are located openings 21, 22, 23, 24 which are aligned respectively with check mechanisms A, B, C and D which include a spring biasing device A1, B1, C1 and D1, and a ball bearing A2, B2, C2 and D2. Flow paths L1, L2, L3 and L4 are therefor defined integral with the hinge 10 or the hub H of FIGS. 1A or 1. The wiper therefor moves clockwise or counter clockwise on pin 40 and forces fluid through line L3 or L2 depending on the direction motion of the wiper 41. The structure of the wiper and the housing is similar to that of a hydraulic actuator. Located within the housing or hub and in communication with lines L3 and L2 which allow for fluid to flow from the actuator, is disposed a relief valve 50 including a piston 55 which is resiliently biased by a spring 60 anchored at end 65 of the housing 67. There is a space 62 defined between the housing 67 and the piston 55. The space 62 is tapered as illustrated in FIG. 2 to allow for more fluid to by-pass the piston the higher the piston 55 travels while maintaining to lift the piston by providing sufficient pressure to so. Disposed in the housing at the bottom seated position of piston 55 is an opening 61 which has a ghost line around it. The opening 61 has a cross sectional diameter that provides an area which is reduced from the area of the cylinder in which the piston 55 travels.

Figure 2A:
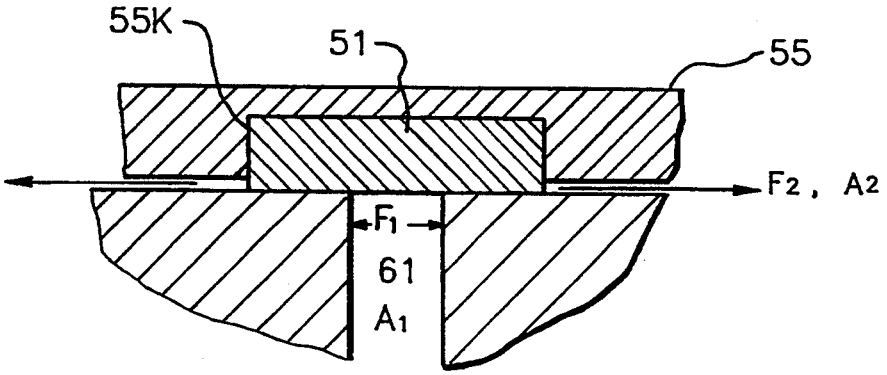
FIG. 2A is a close-up schematic view of the zone in ghost line in FIG. 2 illustrated in a preferred embodiment of the invention.

Referring to FIG. 2A, clearly the piston 55 is illustrated adjacent the outlet 61, wherein the piston has a face F2 and seal 51 which closes the opening 61. Any hydraulic pressure within opening 61 will therefor be exerted upon the seal 51 which has a reduced area F1 to the face F2 of the piston 55. The pressure is exerted on a smaller area F1 of seal 51 than the face F2 while the piston is closed, then a larger force is required to raise the piston sufficiently to expose the face F2 to the hydraulic pressure wherein the seal is lifted from its bottom position. The force then required to raise the piston is reduced substantially as best illustrated in relation to FIG. 10.

The seal 51 is retained within an opening **55*k* of the piston 55 as seen in FIG. 2A. The seal is generally arcuate in shape and made of rubber. When seated within the opening 55*k* the piston 55 is prevented from bottoming out near opening 61. This structure is convenient as it allows greater flexibility in in manufacture of the piston. The seal 51** therefore provides a slight gap between the piston face A2 and the bottom cylinder wall to ensure proper working of the relief valve, and to ensure the piston bottoms out on the seal.

Figure 3:
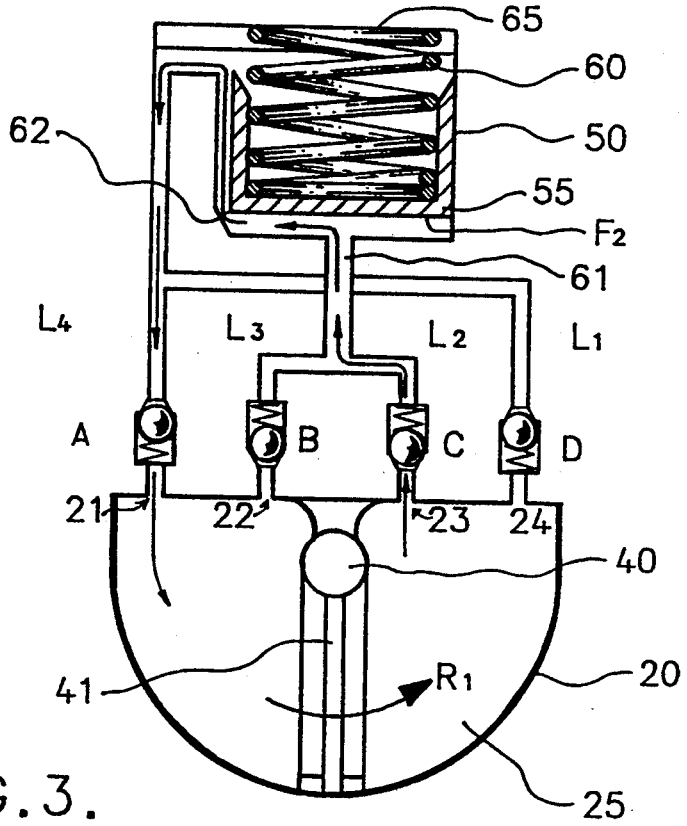
FIG. 3 is identical to FIG. 2 with the exception that the hinge is free to rotate and is in an unchecked position, illustrated in a preferred embodiment of the invention.

Referring to FIG. 3 in relation to FIG. 2, and 2A the wiper 41 is moving in the direction R1. The hinge or hub is no longer in the locked position of FIG. 2 but is now in the moving position. Therefor, the hydraulic fluid within the housing 25 is displaced along line L2 through check C, while inhibited by the check mechanism D from entering the line L1. As the fluid enters along the line L2 toward the relief valve 50, the piston 55 is raised sufficiently to allow the hydraulic pressure to be exerted against the full face F2 of the relief valve 50. The hydraulic fluid however is prevented from entering the line L3 by the check mechanism B and has no alternative path. The fluid therefor displaces the piston 55 in the direction indicated, and by-passes because of the extended channel 62 adjacent the piston 55, and travels down line 4 through check mechanism A, unable to pass to line 1, since the rotor is rotating in the direction R1 closing the check mechanism D. The piston 55 remains lifted from its bottom dead center position until such time as the actuator wiper 41 stops, at which time the hydraulic fluid will mostly return back to the the actuator 25 through checks A and D and the piston will bottom out again as illustrated in FIG. 2. Therefor, a greater force will be required to overcome the static condition of the wiper held by the pivot 40 of the hinge of FIG. 1 or the hub of FIG. 1A.

Figure 4:
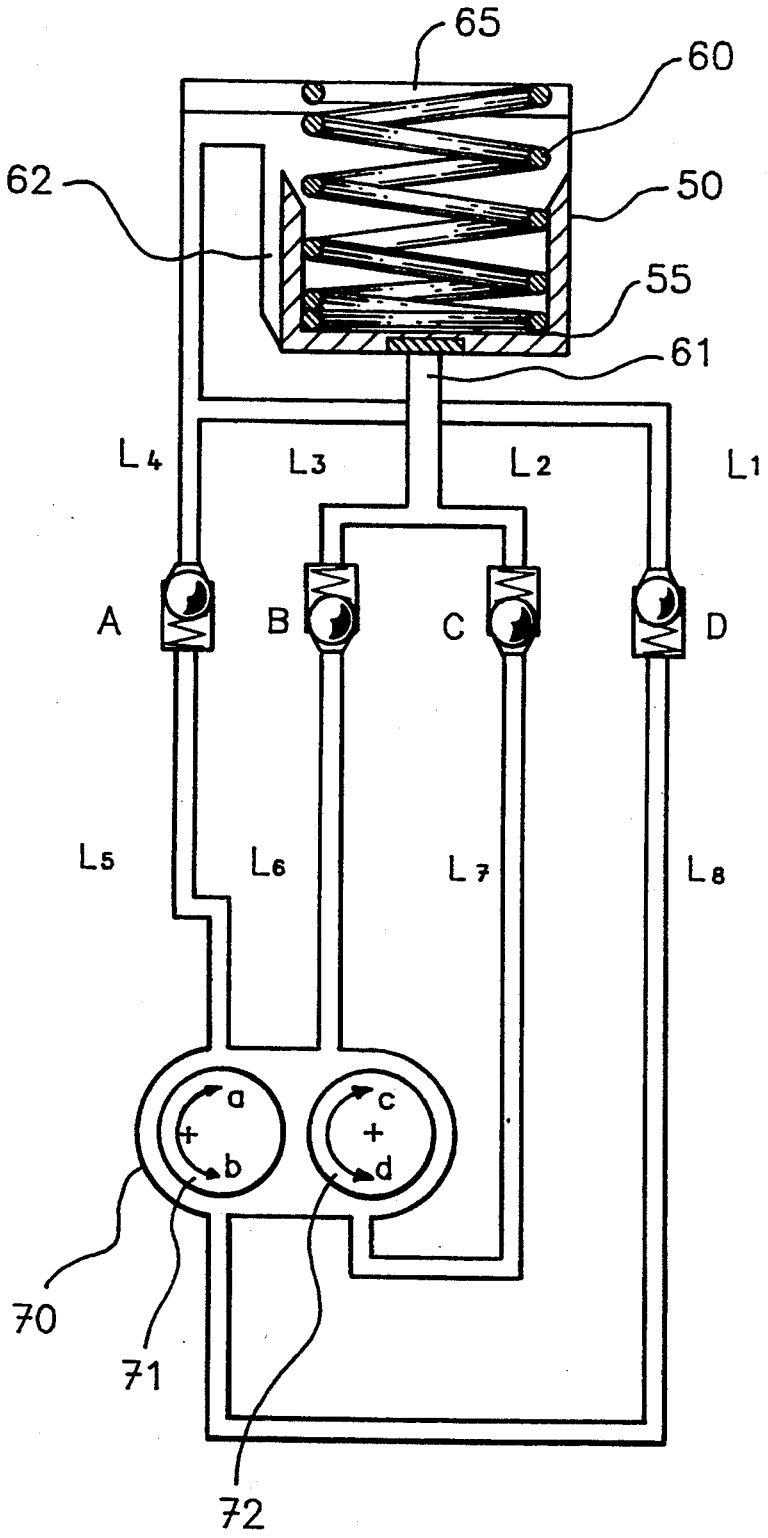
FIG. 4 is an alternative embodiment of the invention.

Referring to FIG. 4 there is illustrated a structure identical in terms of the relief valve to FIGS. 3 and 2 but not in relation to the actuator 25. In this case the actuator 25 has been replaced with a gear pump 70 which includes a set of rotors 71 and 72 which rotate in opposite directions and have lines L5, L6, L7 and L8 in communication with the relief valve through check valves A, B, C and D setup identically in relation to description of FIGS. 2 and 3. The pin 40 may be located on one or the other of the gear pump rotors 71 or 72, the other being a slave in operation. Therefor, if the valve 55 is to be raised in relation to FIG. 2A, a greater force is required on the hub or on the vehicle door for example, to overcome the force required to lift the relief valve as described in relation to FIGS. 2 and 3. The rotors therefor may rotate in a direction B and C which will cause the piston to raise the hydraulic fluid to pass through the openings 62 in the cylinder and return to the gear pump through checks A and D. The operation otherwise would be identical.

Figure 5:
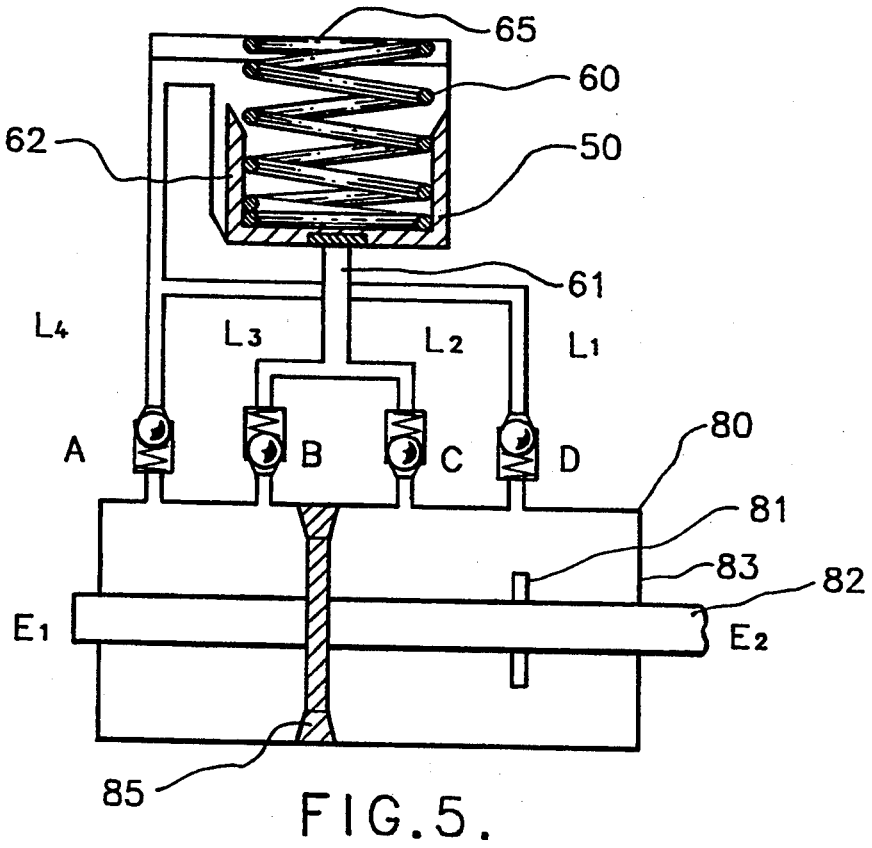
FIG. 5 is an alternative embodiment of the invention.

Referring now to 5 an alternative embodiment of the invention is illustrated wherein the actuator in FIG. 2 is replaced by a cylinder 80 which contains a piston 85 which is a by directional piston moveable to either end E1 or E2 of the cylinder. The piston rod 82 proximate end 81 prevents the piston 85 from passing the check B. Further the stop 81 when the piston moves toward end E2 prevents the piston 85 from passing the check C. Therefor the cylinder 80 and piston 85 therein acts as a pump similar to the actuator in FIGS. 2 and 3 and provides for the passages of fluid through lines L4, L3, L2 and L1 exactly as in the case of FIG. 3. The cylinder 80 would therefor be a portion of the enclosure of for example, a door check in a vehicle door, located in a stationary position in the door. The piston rod 82 would provide the check arm which is fastenable to a vehicle pillar not shown at one end and to the door at the other end. The structure of FIG. 5 would therefor entail the housing of the door check and provide the checking function of the door.

Figure 6:
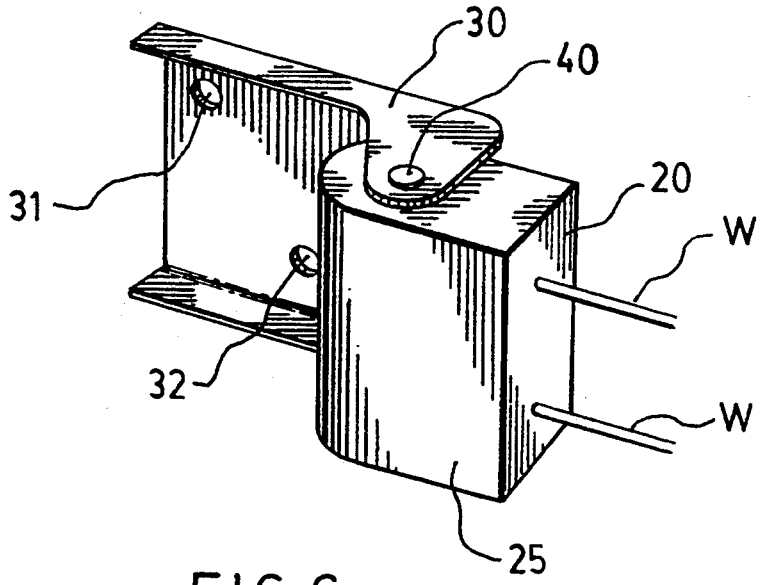
FIG. 6 is identical to FIG. 1 with the exception that electric leads W1 and W2 are included.

Referring now to FIG. 6 there is illustrated a hinge identical to FIG. 1 with the exception that electrical wires W1 and W2 extend from the hinge body for illustration purposes only. The wires may extend in any direction from the bottom or top or back of the hinge. The hub structure of FIG. 1A would benefit from the embodiments which will be described in relation to FIG. 6, wherein a pin including clutch means would be located within the hub of FIG. 1A much the same as the illustration of FIG. 7.

Therefor in FIG. 6 there is provided the hinge body 20 and hinge portions 30 and 25 about a pivot pin 40 having a fastening plate and the openings therethrough 31, 32 to be fixed to either the door or the vehicle frame. In the case of FIG. 1A, as with the previous description, the wheel WH would be rotating about a center 40 which is a pivot about a hub H. The wheel when it rotates would rotate in the direction T1. The structure of FIG. 7 would equally fit within the hub of FIG. 1A and any description in relation to FIG. 7 and following would be implied to just as workable as FIG. 1A.

Figure 7:
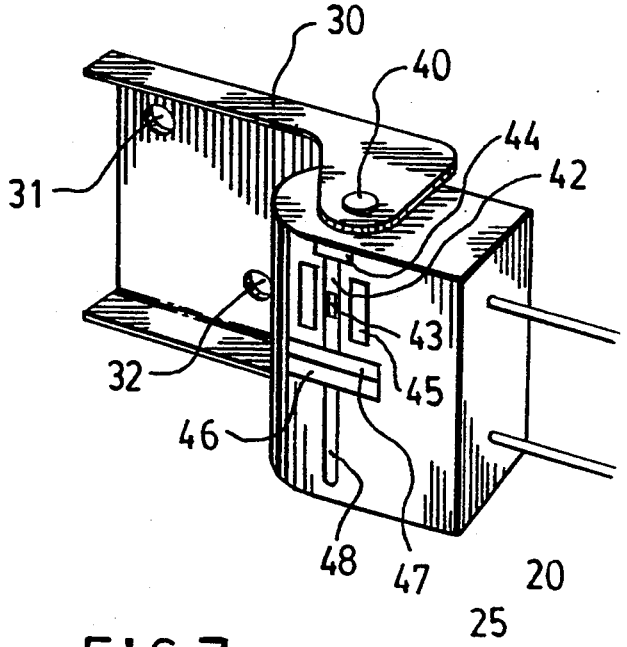
FIG. 7 is identical to FIG. 6 and is cut away in part to view the clutch assembly contained with the hinge illustrated in a preferred embodiment of the invention.
Figure 8:
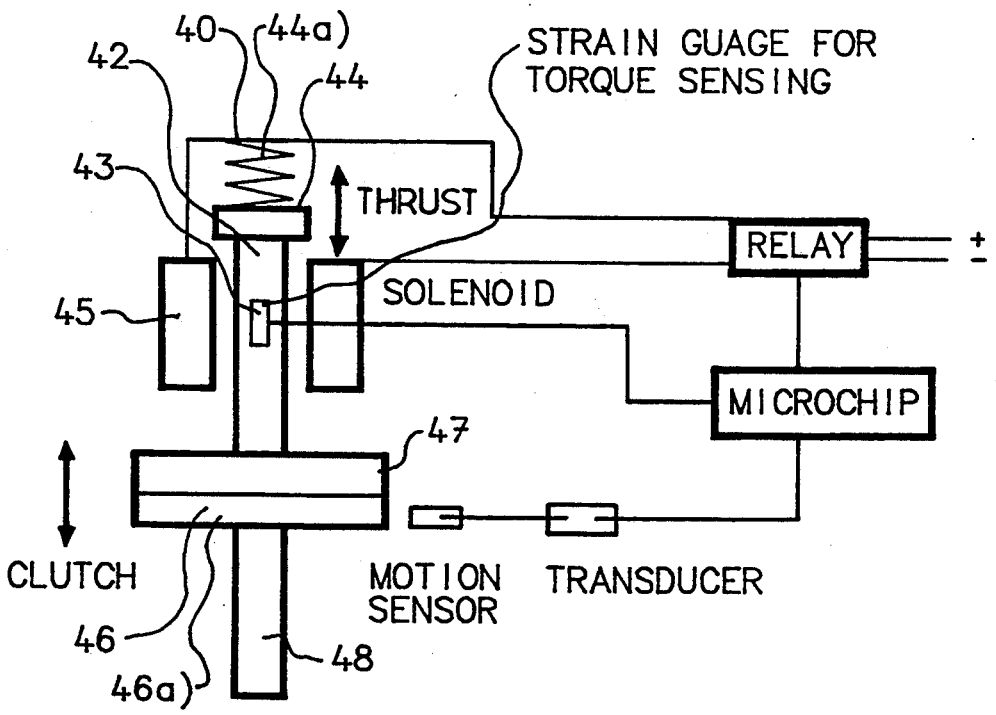
FIG. 8 is a schematic view of the internal workings of the hinge of FIG. 7 to illustrate the components therein illustrated in a preferred embodiment of the invention.

Referring to FIG. 7 there is disclosed the hinge of FIG. 1 wherein an electric check mechanism 44 is provided within the housing 25 of the hinge 20. Electrical leads W1 and W2 will be described hereinafter. A pin having two parts 42 and 48 represents the pivot pin 40 which is affixed at one end to a resilient spring 44A to allow for the thrusting motion of the upper portion 42 of the pin 40. A solenoid 45 is provided around the pin. The pin portion 42 has a strain gauge 43 located thereon, which stain gauge is in communication with a micro chip not shown in FIG. 7. As best illustrated in relation to FIG. 8, the clutches 46 and 47 are separable and allow for the checking of the hinge when the clutches are abutting one another by the adjacent surfaces and the free motion of the pin 40 when the clutch plates 47 and 46 are separated. Score lines are provided on the circumference of the clutch plate 46 which as best seen in relation to FIG. 8 are detected by motion sensors which may be a fibre optics unit interconnected with a transducer which translates the optical signal to electrical signal to be transferred to the micro chip. The lines 46A therefor as best seen in FIG. 8 provided the sensing of such motion. Alternative methods would just as easily be applicable.

Figure 9:
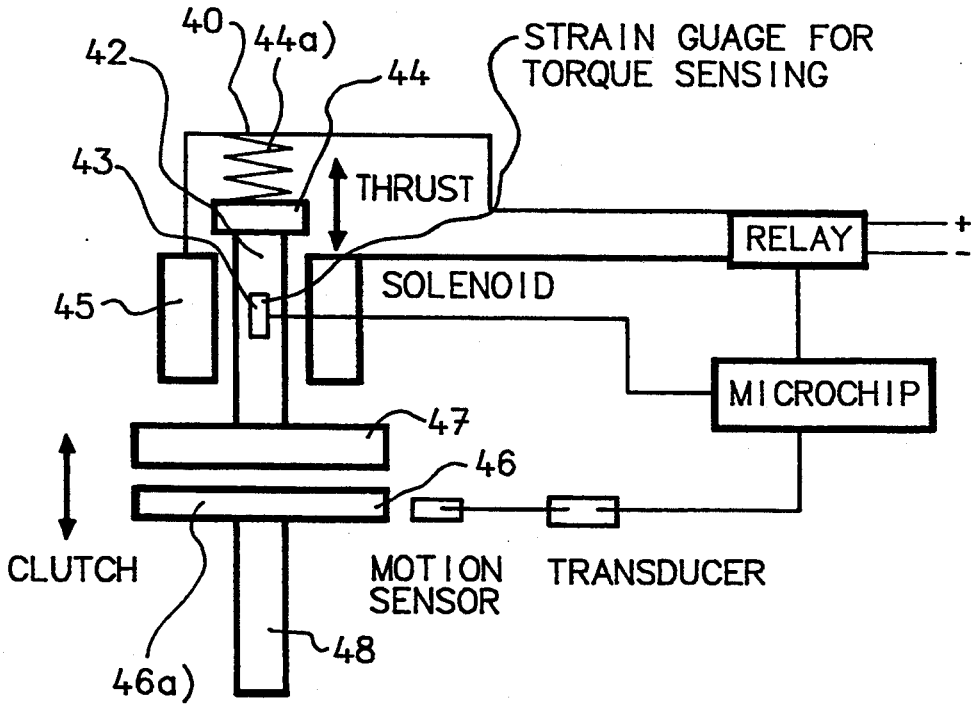
FIG. 9 is identical to FIG. 8 but illustrate the hinge of FIG. 7 in a free to rotate position.

Referring now to FIGS. 7, 8 and 9 the electrical supply W1 and W1 are provided through a relay or the like which is in communication with a micro chip which is designed to accept the feed back signals and provide feed forward signals as required by the system. For example, the mircochip would include a sensing loop to sense the torque via the strain gauge 43 and would not engage the solenoid via the switching relay until such time as a torque condition is sensed at the strain gauge 43. When therefor the torque is sensed at a predetermined level the micro chip will inform the relay to close providing power to the solenoid to allow the clutch plate 47 and a pin portion to move upwardly away from the portion 48, thus separating the clutch plates 46 and 47. At this position the pin is free to rotate without any limitations and will move freely in comparison to the force required to overcome the friction between the two clutch plates 47 and 46. Therefor a lower force is required to maintain the pin in motion once the clutch plates are separated as compared to the force required to separate the clutch plates initially.

When the pin is stationary and not rotating and no force is being exerted upon the door of the hinge or on the hub then there is no torque at 43 either. However, the motion censor informs the mircochip that the clutch is not moving and the pin is not rotating and thus one can discreetly identify the two conditions of static loading and dynamic loading on the pin.

Therefor, Applicant's have provided examples of checking or stop mechanisms which may be designed hydraulically or which may be formed a electro/mechanically as in relation to FIGS. 7 and 8.

Figure 10:
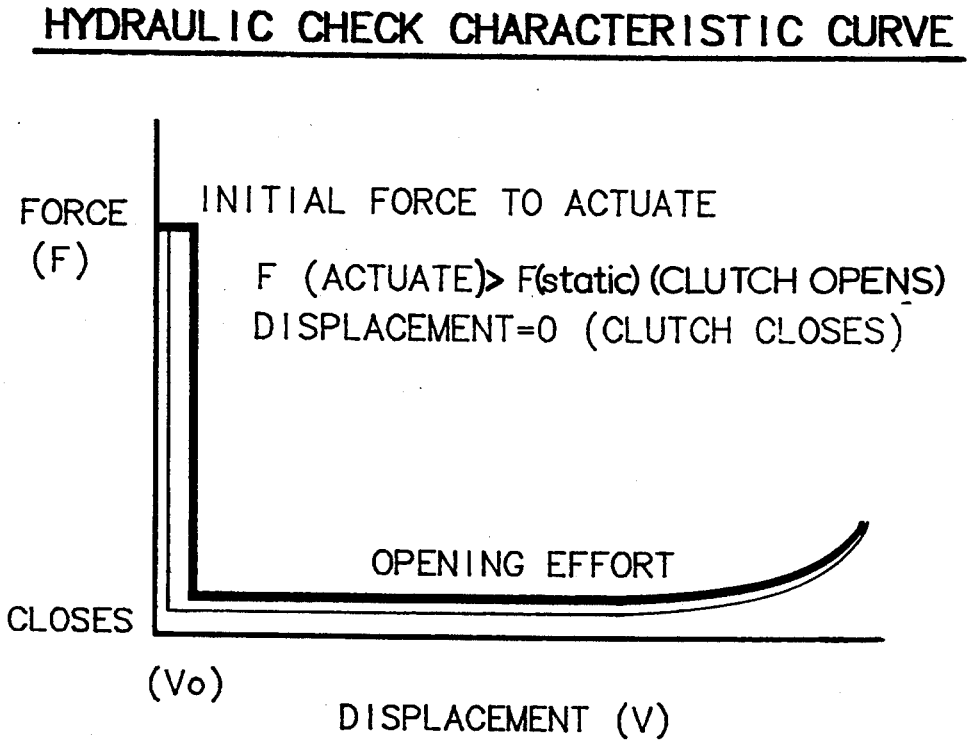
FIG. 10 is a graph of the performance characteristics of the hydraulic check of FIG. 1 illustrated in the preferred embodiment of the invention.
Figure 11:
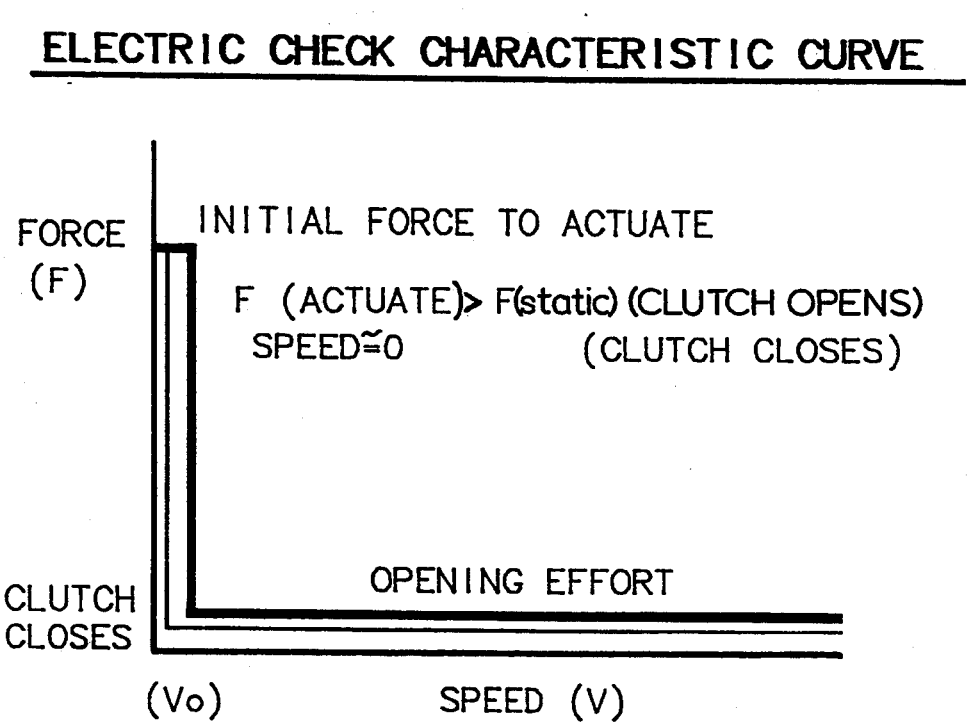
FIG. 11 is a illustration of a chart the performance characteristics of the electric check of FIG. 6.

Referring to FIGS. 10 and 11 the characteristic which Applicant provides in its structures is described by the characteristic curves as in relation to FIGS. 6 and 7.

Referring to FIGS. 10 and 11 the characteristic which Applicant provides in its structures is described by the characteristic curve for both a hydraulic check and an electrical check. The force F (Actuate) initially required to move the door for example, or the wheel is high. This high actuating force requirement therefor ensures the checking of the mechanism being checked without need for supplementary portions. The fact that it is static and has a speed approaching zero or a displacement of hydraulic fluid approaching zero, provides a high force which must be overcome. This force in FIG. 10 is developed by the pressure in the line acting against a reduced area of the piston. Since force is the product of the pressure and the area the initial force to start the motion is established. Once the force required to slightly raise or flex the piston is overcome the effort required to maintain the vehicle door or wheel in motion drops dramatically. This is because the fluid has overcome the resistance of the spring or biasing force and the fluid acts on a larger area thus requiring less pressure to keep the spring compressed and therefore keep the valve open for relatively free flow of the fluid resulting in a reduction in the applied force required to maintain the mechanism in motion. When the door or wheel stops and as the speed or displacement approaches zero, the force returns to the first level of the characteristic as indicated in relation to FIGS. 10 and 11.

If a force is applied at the actuator of F1 this results in a pressure P1 in the system which force F1 is not sufficient to overcome the bias of the spring or rubber material. Instantaneously when a force F2 is applied sufficient to overcome the bias then a higher pressure P2 results in the system and the piston is flexed or raised. However as it is raised the pressure P2 is immediately drastically reduced as the fluid acts on a larger area of the piston. This effect results in an immediate drop in the force applied to the actuator. In practise this drop in the force is comparable to the ratio of the areas effected by the pressure when the piston bottoms and when it is raised.

The characteristic of FIG. 11 is developed more simply in a manner similar to a switch. If the clutch is closed the force to move the actuator is high. Once a torque is sensed and the clutches are separated the force is substantially reduced. The reduced effort will be present as long as the clutches are separated and motion is sensed. If no motion is sensed then the clutches close and the force required to overcome the static position of the actuator is again instantaneously high.

It is therefor the dual characteristic which we have embodied in various example structures which are simple and easy to use which is the essence of the instant invention. Any structure which provides stopping or checking whether it be embodied in a check or a combination hinge check or whether it be embodied in a hub of a wheel can be formed to exhibit the characteristics of FIGS. 10 and 11. Applicant therefor does not restrict its invention to those disclosed in the preferred and alternative embodiments which are provided as examples only of the instant invention.

Referring now to FIGS. 12, 12A, 13, and 14 there is illustrated an alternative embodiment of the invention wherein the piston has been replaced by a rubber diaphragm 28 which is able to withstand hydraulic oil. Therefore similar to FIG. 1 there is illustrated a hinge generally indicated as 10 which is mounted to a vehicle door (not illustrated) by a mounting plate 30 attached to the door and the housing 25 of the hinge attached to the frame of the vehicle. Of course, the attachments may be reversed without effecting the operation of the invention. Mounting plate 30 has openings 31 and 32 for mounting purposes. A pin 40 extends generally through the hinge body 25 from top to bottom of the hinge.

The internal components of the hinge body 25 are illustrated wherein the pin 40 of the housing 20 of FIGS. 12 and 12A includes a wiper portion 41 moveable within the housing 25. Hydraulic oil fills the space within the housing 25. At one end of the housing are located openings 21, 22, 23, 24 which are aligned respectively with check mechanisms K, L, M, and N which include a spring biasing device A1, B1, C1 and D1, and a ball bearing A2, B2, C2 and D2 as seen in FIG. 2. Flow paths **25*d*, 25*c*, 25*b* and 25*a* are therefor defined integral with the hinge 10. The wiper therefor moves clockwise or counter clockwise on pin 40 and forces fluid through line 25*b* depending on the direction motion of the wiper 41. The structure of the wiper and the housing is similar to that of a hydraulic actuator. Located within the housing or hub and in communication with lines which allow for fluid to flow from the actuator, is disposed a rubber diaphragm 28 including a resilient piston 29 which is a truncated cone contained within the opening 26*h* of the housing 26 the piston 29 is resiliently biased because of the flexibility of the rubber as it is compressed against the cover 26*a*. Disposed in the housing at the bottom seated position of piston 29 is an opening 61. The opening 61 has a cross sectional diameter that provides an area which is reduced from the area of the piston contained in opening 26*h***.

Referring to FIGS. 12 and 13 there is illustrated the hinge 10 which is modular and includes an actuator portion 25 and a relief valve portion 26. The relief valve portion includes a cover **26*a* and an area 26*b* of the actuator portion 25 which the cover 26*a* engages when assembled by conventional means. Located between the cover 26*a* and the actuator portion 26*b* is a diaphragm 28 as best seen in FIG. 14. The diaphragm portion 28 has a piston portion 29 being shaped as a truncated cone and retained in an opening 26*h* defined between the portions 26*a* and 26*b*. This piston portion 29 behaves similar to the previously described piston portions in use. Adjacent the piston portion 29 on the actuator portion 26*b* are located inlets and outlets for hydraulic oil 26*c* and 26*d* respectively. The diaphragm also includes four checking flaps 28*b* located at the other end of the module 26. These checking flaps 28*b* are located adjacent pairs of openings 26*e* and 26*f* of the actuator portion 26*b* (only one of each pair being illustrated in FIG. 13), and openings 26*g* and 26*j* (only one of each pair being illustrated in FIG. 13) of the portion 26*a*. The openings 26*g* and 26*j* provide the ability of the checking flaps 28*b* to move towards the portion 26*a* but not away from that portion thus providing one way checking. The necessary paths of fluid flow required within the portions 26*a* and 26*b*, similar to FIGS. 3 and 12A**, are not illustrated as the operation of one way checking is identical whether flaps or ball bearings are used.

Referring now to FIG. 14 the modular diaphragm 28 is illustrated which provides in a one piece construction the resilient piston 29 and the checking flaps **28*b*. The position of the openings 26*a* and 26*d* are illustrated to orient the piston 29 in relation to the openings. Of course as presented in FIG. 12A it is not necessary that the checking flaps be provided with the diaphragm 28**. The standard assembly using ball bearings may be used as well. For cost reasons and compactness of the finished assembly its is however preferred.

Referring to FIG. 12A the operation thereof is similar to FIG. 3. When the actuator is rotated in the direction R1 fluid flows through opening 23 and engages the area of the piston 29 adjacent the opening 61. The piston 29 is part of the diaphragm 28 which does not include checking flaps. The resilient piston compresses therefore in the opening **26*h* and causes the portion of the piston around the opening 61 to flex into the opening 26*h* thereby presenting to the fluid a greater area of the resilient piston 29, which area is generally concave, sufficient to allow communication of the fluid with the return port 25*d*. The structure of the piston 29 being a truncated cone is deliberate as the piston will deflect about its perimeter and its centre, to compress the top, the top having a difference in cross-section, than the bottom of the piston. The housing is vented at 25*r*** to prevent an excessive vacuum from forming when the actuator is moving. This is an important consideration as it is required that there be no excessive vacuum developed for the correct operation of the unit. Any alternative means of achieving this end would be acceptable. This principle of course applies to the other examples as well.

Referring now to FIGS. 12, 13 and 14, the operation thereof is identical to that described above in relation to FIG. 12A with the exception that the checking flaps are included in the design of the diaphragm. When the actuator integral with the hinge 10 is rotated in the direction shown in FIG. 12A the resilient piston 29 will compress as shown in FIGS. 13 or 12A into the opening **26*h* and the appropriate checking flaps 28*b* will allow passage of fluid because they will move into the openings 26*g* and 26*j* under the pressure of the fluid. The remaining checking flaps cannot move toward portion 26*b* as no openings are provided therein to do so. Otherwise the operation of the module is very similar to the operation of the unit of FIG. 12A**.

Figure 15:
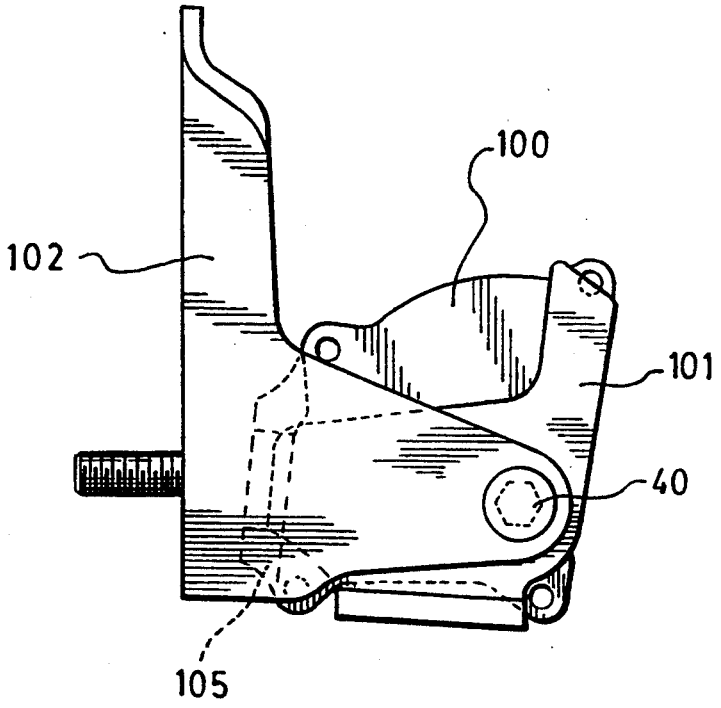
FIG. 15 is a top view of a hinge embodying the door check illustrated in an alternative embodiment of the invention.

Referring now to FIG. 15, there is illustrated an infinite door check integral with a hinge assembly. The door check 100 being assembled as a hinge, having a body portion or a half 102 and a door half 101 as is illustrated in relation to FIG. 1. The door check portion, however, 100 in this description is similar in operation to the diaphragm portion described in relation to FIGS. 12, 13, 14 and 12A presenting a similar action in use.

Figure 15A:
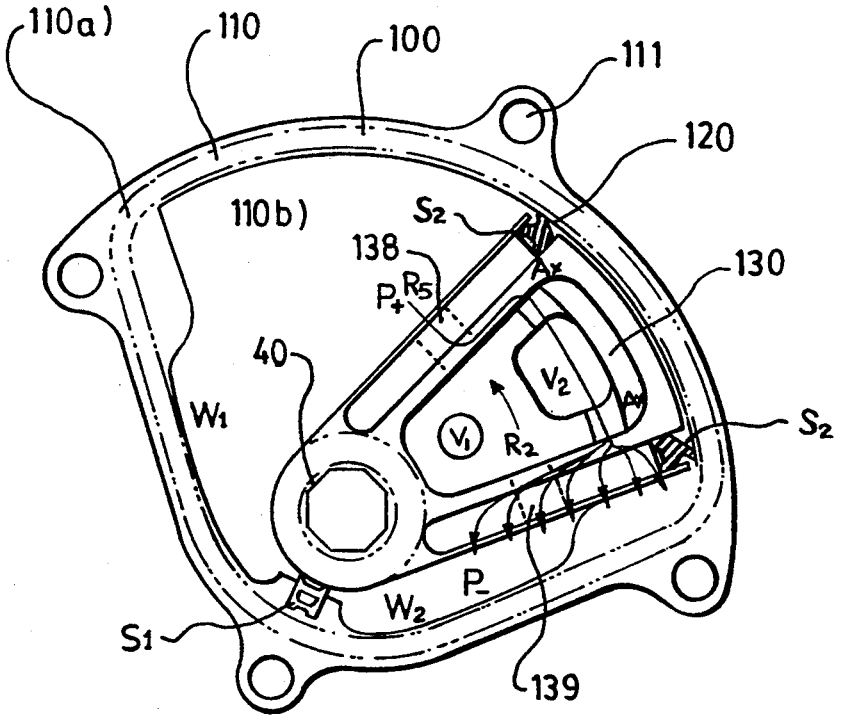
FIG. 15A is a top view of the door check portion of FIG. 15 with the top removed illustrated in an alternative embodiment of the invention.

The door check portion 100 the silhouette of which is best seen in relation to FIG. 15A has a cut out located adjacent the door half portion 101 in order to assemble the hinge. The hinge pin 40 engages with the body half 102 so that the turning moment developed when the hinge is operated is resolved through the hinge pin and also at the joint between the door check 100 and the door half 101. The hinge pin 40 has a seal about the circumference thereof in order to prevent the weeping of hydraulic fluid past the hinge pin.

Figure 15B:
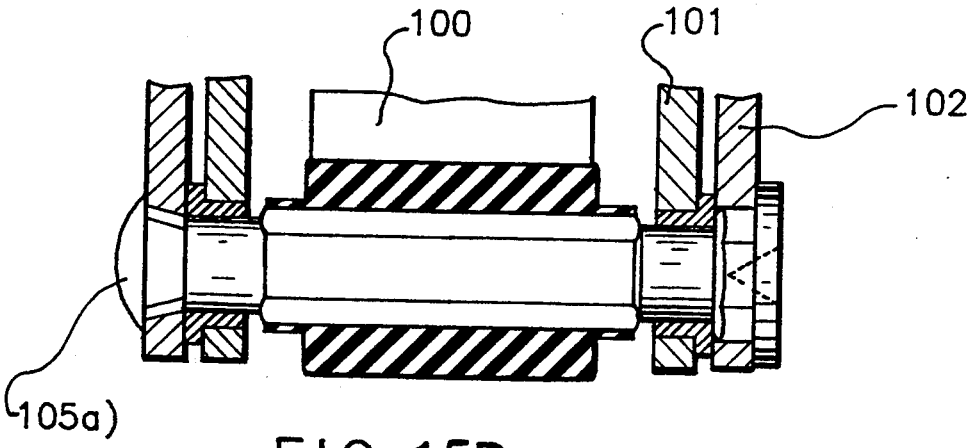
FIG. 15B is a cut away view along the section X X of FIG. 15 wherein the housing is not illustrated.

Referring now to FIG. 15B, the cross-sectional view of the hinge 40 is presented to illustrate the assembly of the body half, the door half and the check. Therefore, the hinge pin carries the body half 102 as well as the door half 101 having upper and lower portions as well as the check 100. The hinge pin is riveted at one end 105A to complete the assembly.

Figure 17:
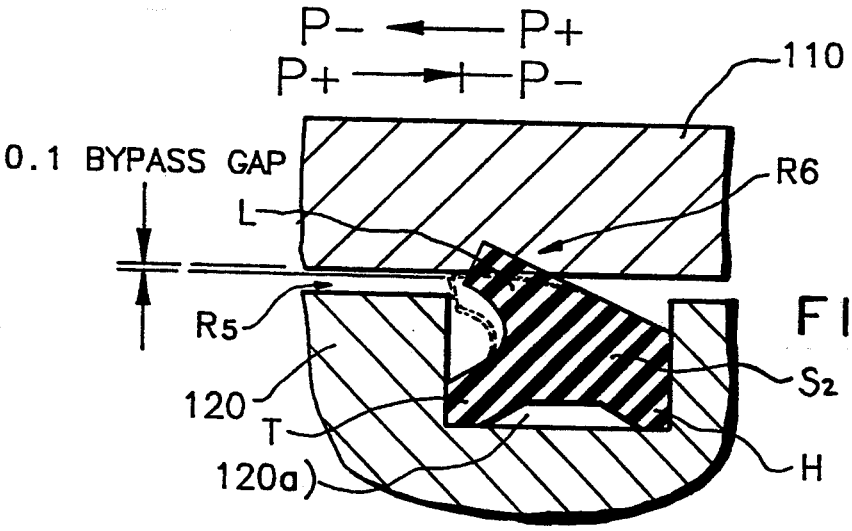
FIG. 17 is a cross-sectional view of the seal of the resilient wiper illustrated in FIG. 16 and illustrated in a preferred embodiment of the invention.

Referring now to FIG. 15A there is illustrated a housing 110 for the door check 100. The housing is fastened via rivet or screw openings 111 to the top end of the check, not shown. The door check housing 110 has a seal extending around the circumference thereof at 110A to prevent leakage of hydraulic fluid. The opening 110B includes an actuator or wiper 120 supported by a hinge pin 40 preferably made from metal and having an opening 138 and 139 extending through each end. The wiper 120 is similar to a sector of a circle having a generally pie shaped form and having contained therein a resilient, flexible spring or diaphragm 130 which is made from rubber or any other resilient material which can withstand being exposed to hydraulic fluid. The resilient diaphragm or spring portion 130 has contained therein voids V1 and V2 which may either comprise an air pocket in each void V1 and V2 or be filled with resilient closed cell foam such as sponge which restores its original shape after being compressed. A circumferential recess or groove is established about the perimeter of the wiper 120 as best seen in relation to FIG. 22 within which a circumferential seal S2 rests. The circumferential seal S2 has a wiper arm which extends in one direction as best seen in FIG. 17 which seals against passage of hydraulic fluid in the opposite direction to the extension of the wiper arm of the seal S2. This will be described hereinafter. A seal S1 is located proximate the hinge pin the details of which are best seen in relation to FIG. 18 to divide the volumes 110B in half on either side of the wiper W1 and W2. Therefore when the wiper 120 is moved in a direction R2, fluid will pass through the opening 138 under pressure and flow in the direction R5 and will compress the diaphragm or resilient spring 130 around the opening 138 adjacent that spring 130 to allow the passage of fluid through the cut-out portion AX through the spring 130 and through the circumferential seal S2 in order to exit to volume W2. The movement of the oil in this fashion is similar to the passage of hydraulic fluid through the diaphragm of FIG. 13 and provides the same characteristic as described in relation to FIG. 10.

Figure 16:
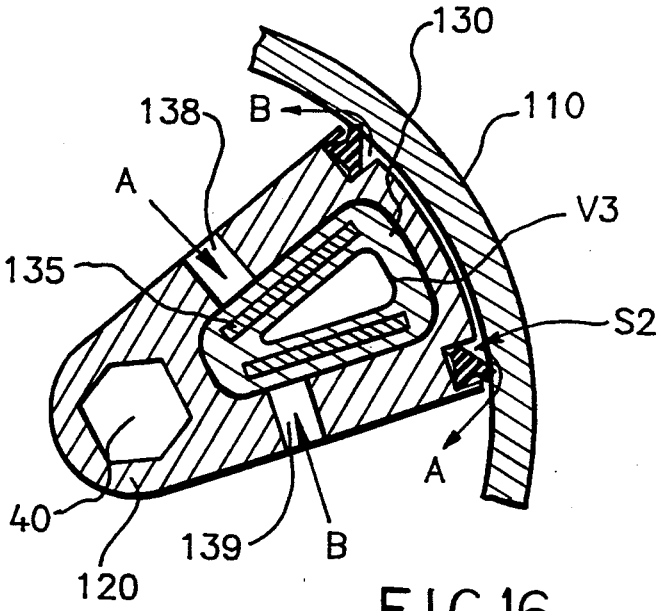
FIG. 16 is a detailed view of the resilient spring of FIG. 15A contained within the door check illustrated in FIG. 15 and illustrated in a preferred embodiment of the invention.

Referring now to FIG. 16, the details of the wiper 130 are presented to illustrate the passage of hydraulic fluid through the openings 138 or 139 depending on the direction of the rotation of the wiper 120. In this illustration the resilient spring 130 includes metal reinforcing portions 135 which may or may not be included, and a singular void V3 filled with closed cell resilient foam such as sponge. When the wiper moves in the direction indicated in FIG. 15A, the fluid will flow in a direction A through opening 138 and will pass in a corresponding direction A around the seal S2. If the fluid moves in the opposite direction wherein the wiper 120 would be moving in a direction opposite to R2 in FIG. 15A, then the fluid will flow through the opening 139 causing the same characteristic as illustrated in relation to FIG. 10 and compress the spring portion 130 into the void V3 allowing the fluid to pass through the seal S2 in a direction B and the characteristics sought by the instant invention.

Referring to FIG. 17, a close-up of the detail of the seal S2 is illustrated abutting the housing 110 and contained within a recess 120A of the wiper 120. The recess 120A is best seen in relation to FIG. 22 wherein the seal has a head H and a tail T which engages the side walls of the recess 120A to anchor the seal in position and to allow the leg of the wiper portion L to abut the housing 110 in one direction and prevent the passage of fluid in the direction R5 when the housing is assembled as shown in the compressed state in ghost out line. The seal will allow fluid flow however in the direction R6 which is generally in the same direction of extension of the leg L when it abuts the housing 110.

Figure 18:
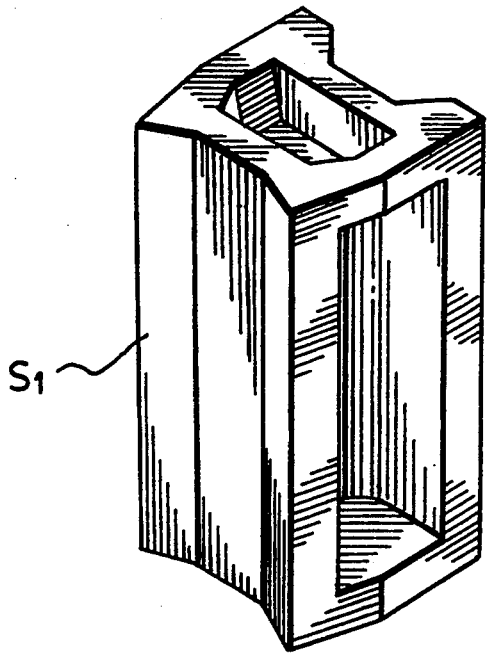
FIG. 18 is a perspective view of the seal S1 of FIG. 15A illustrated in a preferred embodiment of the invention.

Referring now to FIG. 18 a perspective view of the seal S1 is presented which provides cut-out portions 1 and 2 at each end and at each side of the seal to allow for deflection of the seal and improved sealing in use.

Figure 19:
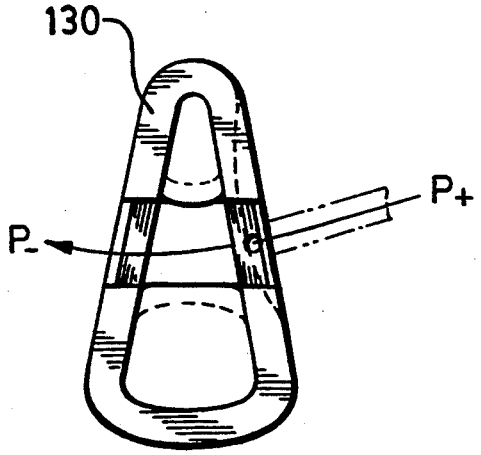
FIG. 19 is a schematic view of the resilient spring contained within the wiper of FIG. 16.

Referring now to FIG. 19, a schematic view of the resilient diaphragm or spring 130 is presented illustrating the cut-out channel AX at the top thereof which may equally be at the bottom thereof or on both sides which allows for passage of fluid in both directions. Of course the void is present either filled with air or closed cell resilient foam such as sponge.

Figure 20:
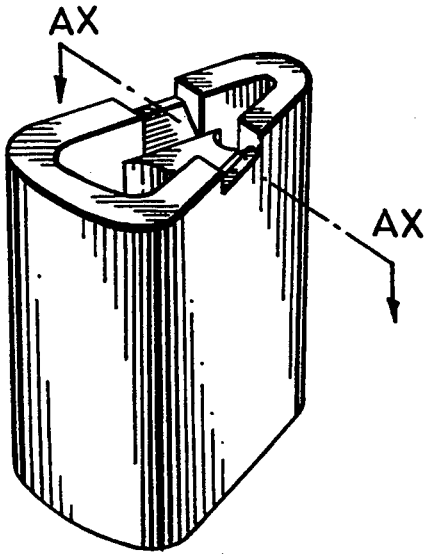
FIG. 20 is a perspective view of the resilient spring of FIG. 19.

FIG. 20 is a perspective view of FIG. 19 with all of the attributes thereof.

Figure 21:
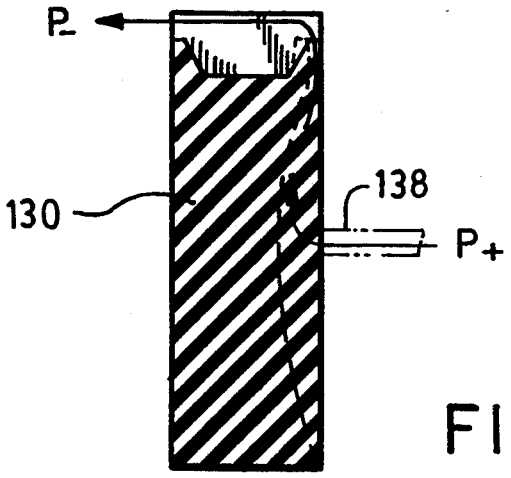
FIG. 21 is a schematic view of the operation of the resilient spring when pressure is exerted upon it developing a similar characteristic to that described in relation to FIG. 13 and FIG. 12A.

FIG. 21 is a close-up view of the opening for example 138 in the resilient spring or diaphragm portion 130 adjacent the opening 138 of the wiper 120 illustrating the deflection of the spring portion 130 in the direction of the oil pressure similar to that illustrated in relation to FIG. 12A and FIG. 13. The hydraulic fluid will therefor flow through the opening 138 and through the opening AX and about the seal S2 in the appropriate direction depending upon the rotation of the wiper 120.

Figure 22:
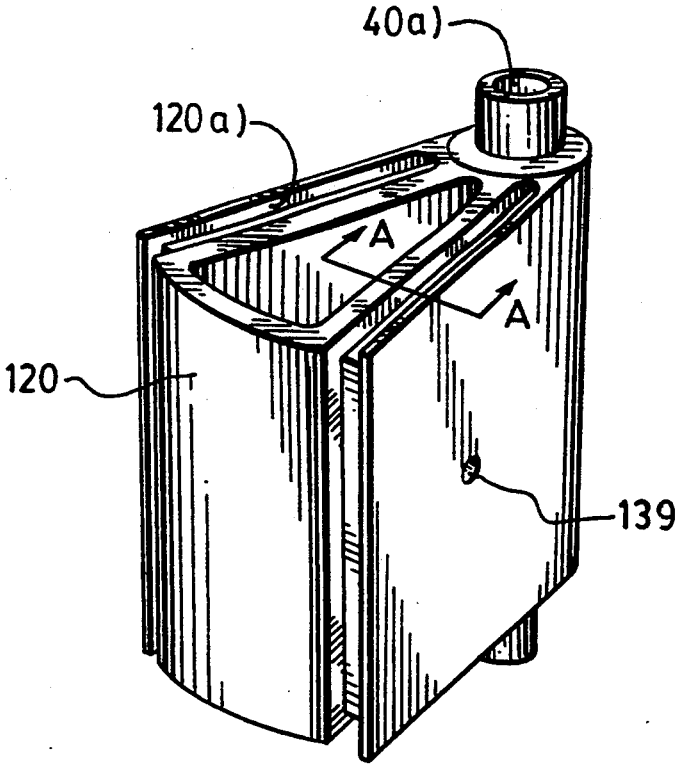
FIG. 22 is a perspective view of the wiper portion of FIG. 15A illustrating the recesses in which the seal S2 is retained illustrated in a preferred embodiment of the invention.
Figure 23:
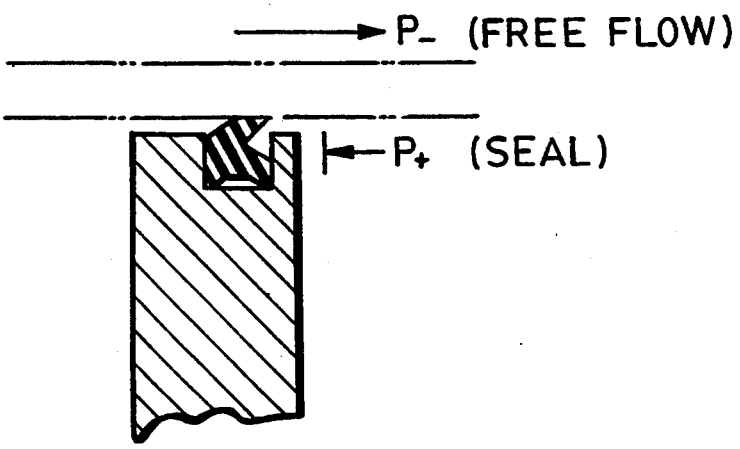
FIG. 23 is a close-up cross-sectional view of the recess of FIG. 22 containing the seal S2 of FIG. 15A.

FIG. 22 is a view of the wiper 120 illustrated in perspective view mounted on the hinge pin 40 illustrating the details of the recess 120A within which the seal S2 is contained as best illustrated in relation to FIG. 23. The wiper 120 is formed with an integral collar 40A through which the hinge pin 40 fits when the check is assembled with the hinge.

As may changes can be made to the preferred embodiments of the invention without departing from the scope thereof; all matter contained herein is to be considered illustrative of the invention and not in a limiting sense.

The embodiments of the invention in which an exclusive property or privilege is claimed are as follows:

1. A hinge comprising a check or stop for a moveable member, the hinge having a first half and a second half, one of the halves having disposed therewith actuated means, actuated by the movement of the moveable member and the movement of the first half and second half of the hinge with respect to one another, the hinge having disposed therewith automatic switching means having means to provide a first value of a predetermined characteristic when the moveable member is substantially static and means to reduce the value of the predetermined characteristic to a second substantially lower value of the predetermined characteristic when the moveable member is substantially in motion, the switching means to control the checking and release of the actuated means and the moveable member, the moveable member being moveable from a first state, wherein the moveable member is substantially static, checked, and exhibits a first value for a predetermined characteristic of the actuated means, to a second state wherein the moveable member is substantially in motion, unchecked, and exhibits a second value of the predetermined characteristic of the actuated means, the value of the predetermined characteristic of the actuated means being available to the automatic switching means, wherein when the moveable member is in a static state the first value of the predetermined characteristic available to the automatic switching means provides checking of the actuated means and checking of the motion of the moveable member, wherein when the moveable member is substantially in motion the second value of the predetermined characteristic available to the automatic switching means provides release of the actuated means and the moveable member to allow ease of movement thereof.

2. The check or stop or claim 1 wherein the switching means includes sensing means to sense the value of the predetermined characteristic and feedback means to feedback the value of the predetermined characteristic to the automatic switching means.

3. A hinge comprising a check or stop for a moveable member, the hinge having a first half and a second half, one of the halves having disposed therewith hydraulic actuated means actuated by the movement of the moveable member, and the movement of the first half and second half of the hinge with respect to one another, the hinge having disposed therewith automatic switching means having means to provide a first value of a predetermined characteristic when the moveable member is substantially static and means to reduce the value of the predetermined characteristic to a second substantially lower value of the predetermined characteristic when the moveable member is substantially in motion, the switching means to control the checking and release of the hydraulic actuated means and the moveable member, the moveable member being moveable from a first state, wherein the moveable member is substantially static, checked, and exhibits a first value for a predetermined characteristic of the hydraulic actuated means, to a second state wherein the moveable member is substantially in motion, unchecked, and exhibits a second value of the predetermined characteristic of the hydraulic actuated means, the value of the predetermined characteristic of the hydraulic actuated means being available to the automatic switching means, wherein when the moveable member is in a static state the first value of the predetermined characteristic available to the automatic switching means provides checking of the hydraulic actuated means and checking of the motion of the moveable member, wherein when the moveable member is substantially in motion the second value of the predetermined characteristic available to the automatic switching means provides release of the hydraulic actuated means and the moveable member to allow ease of movement thereof.

4. The check or stop of claim 3 wherein the automatic switching means is a pressure relief valve.

5. The check or stop of claim 3 or 4 wherein the predetermined characteristic is force.

6. A hinge comprising a check or stop for a moveable member, the hinge having a first half and a second half, one of the halves having disposed therewith fluid actuated means actuated by the movement of the moveable member, and the movement of the first half and second half of the hinge with respect to one another, the hinge having disposed therewith pressure relief means having means to provide a first value of a fluid pressure when the moveable member is substantially static and means to reduce the value of the fluid pressure to a second substantially lower value of the fluid pressure when the moveable member is substantially in motion , the pressure relief means to control the checking and release of the actuated means and the moveable member, the moveable member being moveable from a first state, wherein the moveable member is substantially static, checked, and exhibits a first value for a fluid pressure of the actuated means, to a second state wherein the moveable member is substantially in motion, unchecked, and exhibits a second value of the fluid pressure of the actuated means, the value of the fluid pressure of the actuated means being available to the pressure relief means, wherein when the moveable member is in a static state the first value of the fluid pressure available to the biased pressure relief means provides checking of, the actuated means, and the checking of the motion of the moveable member, wherein when the moveable member is substantially in motion the second value of the fluid pressure available to the pressure relief means provides release of, the actuated means, and the moveable member, to allow ease of movement thereof.

7. The check or stop of claim 6 wherein the moveable member is a vehicle door.

8. The check or stop of claim 6 or 7 wherein the pressure relief means is biased.

9. The check or stop of claim 6 or 7 wherein the actuated means is a hinge including an integral hydraulic actuator.

10. The check or stop of claim 9 wherein the actuator has at least one wiper blade dividing the actuator into two halves.

11. The check or stop of claim 10 wherein each half of the actuator is in communication with the pressure relief means.

12. The check or stop of claim 10 wherein the actuator is integral with the hinge.

13. The check or stop of claim 10 wherein check valve means are provided in paths of communication with the pressure relief means.

14. The check or stop of claim 9 wherein check valve means are provided in paths of communication with the pressure relief means.

15. The check or stop of claim 9 wherein the pressure relief means is a pressure relief valve wherein means are provided with a housing containing the valve or with the valve to allow fluid to by pass the valve.

16. The check or stop of claim 15 wherein the housing or valve includes means on the face of the valve piston or with the housing proximate the face of the valve piston to isolate a portion of the face when the valve is closed and to exert the fluid pressure on that isolated portion of the face only until the valve opens, wherein the fluid pressure is exerted on the full face of the valve piston.

17. The check or stop of claim 6 or 7 wherein the actuated means is a hinge including an integral hydraulic gear pump.

18. The check or stop of claim 17 wherein the pump has two rotors rotatable in opposite directions effecting fluid flow in two directions, the fluid flow being in communication with the pressure relief means.

19. The check or stop of claim 18 wherein the pump is integral with the hinge.

20. The check or stop of claim 17 wherein check valve means are provided in paths of communication with the pressure relief means.

21. The check or stop of claim 17 wherein the pressure relief means is a pressure relief valve wherein means are provided with a housing containing the valve or with the valve to allow fluid to by pass the valve.

22. The check or stop of claim 21 wherein the housing or valve includes means on the face of the valve piston or with the housing proximate the face of the valve piston to isolate a portion of the face when the valve is closed and to exert the fluid pressure on that isolated portion of the face only until the valve opens, wherein the fluid pressure is exerted on the full face of the valve piston.

23. The check or stop of claim 6 or 7 wherein the actuated means is a hydraulic cylinder operable in two directions and being divided into two chambers.

24. The check or stop of claim 23 wherein check valve means are provided in paths of communication with the pressure relief means.

25. The check or stop of claim 23 wherein each chamber is selectively in communication with the pressure relief means.

26. The check or stop of claim 25 wherein check valve means are provided in paths of communication with the pressure relief means.

27. The check or stop of claim 23 wherein the pressure relief means is a pressure relief valve wherein means are provided with a housing containing the valve or with the valve to allow fluid to by pass the valve.

28. The check or stop of claim 27 wherein the housing or valve includes means on the face of the valve piston or with the housing proximate the face of the valve piston to isolate a portion of the face when the valve is closed and to exert the fluid pressure on that isolated portion of the face only until the valve opens, wherein the fluid pressure is exerted on the full face of the valve piston.

29. The check or stop of claim 6 or 7 wherein the pressure relief means is a pressure relief valve wherein means are provided with a housing containing the valve or with the valve to allow fluid to by pass the valve.

30. The check or stop of claim 29 wherein the housing or valve includes means on the face of the valve piston or with the housing proximate the face of the valve piston to isolate a portion of the face when the valve is closed and to exert the fluid pressure on that isolated portion of the face only until the valve opens, wherein the fluid pressure is exerted on the full face of the valve piston.

31. A hinge comprising a hinge half affixed to a moveable member and a hinge half affixed to a supporting structure for the moveable member and fastened to one another by a pivot, the hinge pivot being affixed to an actuator moveable within one of the hinge halves, the half of the hinge having the actuator disposed therewith having disposed therewith a liquid, the hinge having ports engaged with the fluid to allow passage of the fluid to and from a relief valve including a biased piston having a face having a first area and a second larger area within a cylinder having an inlet, said passages including means disposed therewith to allow the liquid to flow in only one direction to the relief valve from the hinge half containing the actuator, or from the relief valve to the hinge half containing the actuator, the inlet of the relief valve being of a predetermined cross section and substantially equal to the first area of the piston and engaging the piston of the relief valve proximate the first area of the face of the piston, the actuator being moveable in the clockwise and counterclockwise direction about the hinge pivot and causing the liquid to flow from the hinge half containing the actuator to and from the relief valve, wherein when the moveable member is substantially static the actuator is substantially static and the liquid is substantially stationary and exerts a first pressure value on the first area of the piston as required by the stiffness or resistance of the biased piston, the effort required to move the moveable member is a first value, wherein once the first value is achieved the piston in the cylinder lifts sufficiently from the bottom of the cylinder to allow the liquid to exert a pressure on the second area of the face of the piston thereby reducing the effort to maintain the moveable member in motion once set in motion to a second predetermined value significantly less than the first value, wherein when the moveable member is substantially static throughout its full range of motion it is substantially checked at that position until such time as a force is applied which is sufficiently large enough to overcome the biased piston, after which point the effort required to maintain the moveable member in motion is substantially reduced.

* * * * *